US010681462B2

(12) United States Patent
Lee et al.

(10) Patent No.: US 10,681,462 B2
(45) Date of Patent: Jun. 9, 2020

(54) ELECTRONIC APPARATUS, METHOD FOR CONTROLLING THEREOF AND THE COMPUTER READABLE RECORDING MEDIUM

(71) Applicant: SAMSUNG ELECTRONICS CO., LTD., Suwon-si (KR)

(72) Inventors: Da-young Lee, Suwon-si (KR); Jeong-kee Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 43 days.

(21) Appl. No.: 16/027,641

(22) Filed: Jul. 5, 2018

(65) Prior Publication Data

US 2019/0098410 A1 Mar. 28, 2019

(30) Foreign Application Priority Data

Sep. 22, 2017 (KR) ..... 10-2017-0122546

(51) Int. Cl.

| | |
|---|---|
| ***H04R 5/04*** | (2006.01) |
| ***H04R 29/00*** | (2006.01) |
| ***H04R 3/12*** | (2006.01) |
| ***H04R 5/02*** | (2006.01) |

(52) U.S. Cl.

CPC ..... *H04R 5/04* (2013.01); *H04R 3/12* (2013.01); *H04R 29/001* (2013.01); *H04R 5/02* (2013.01); *H04R 2400/01* (2013.01); *H04R 2420/09* (2013.01)

(58) Field of Classification Search

CPC ..... H04R 5/04; H04R 3/12; H04R 29/001; H04R 5/02

USPC ..... 381/300, 306, 307, 26, 28

See application file for complete search history.

(56) References Cited

U.S. PATENT DOCUMENTS

| | | | | |
|---|---|---|---|---|
| 2003/0185400 | A1* | 10/2003 | Yoshizawa ..... | H04N 21/43615 381/58 |
| 2008/0310641 | A1 | 12/2008 | Park | |
| 2009/0110218 | A1* | 4/2009 | Swain ..... | H03G 5/165 381/300 |
| 2011/0026743 | A1 | 2/2011 | Lowe et al. | |
| 2012/0057712 | A1 | 3/2012 | Deschamp et al. | |

(Continued)

FOREIGN PATENT DOCUMENTS

| | | | |
|---|---|---|---|
| JP | 4487255 | B2 | 6/2010 |
| JP | 2014-176043 | A | 9/2014 |

(Continued)

OTHER PUBLICATIONS

International Search Report (PCT/ISA/210) dated Sep. 21, 2018, issued by the International Searching Authority in counterpart International Patent Application No. PCT/KR2018/006095.

(Continued)

*Primary Examiner* — Thjuan K Addy

(74) *Attorney, Agent, or Firm* — Sughrue Mion, PLLC

(57) ABSTRACT

An electronic apparatus is provided. The electronic apparatus includes an output circuit, an input circuit, and a processor. The output circuit is connected to plural speaker devices. The processor controls the output circuit to cause each of the speaker devices to output an audio signal, and identifies whether each of the speaker devices is connected based on the audio signal received through the input circuit.

20 Claims, 9 Drawing Sheets

(56) References Cited

U.S. PATENT DOCUMENTS

| | | | |
|---|---|---|---|
| 2014/0093085 | A1 | 4/2014 | Jarvis et al. |
| 2015/0301836 | A1 | 10/2015 | Chung et al. |
| 2017/0075785 | A1 | 3/2017 | Kano et al. |

FOREIGN PATENT DOCUMENTS

| | | | |
|---|---|---|---|
| KR | 10-2009-0045597 | A | 5/2009 |
| KR | 10-1445637 | B1 | 10/2014 |
| WO | 2012/137190 | A1 | 10/2012 |

OTHER PUBLICATIONS

Written Opinion (PCT/ISA/237) dated Sep. 21, 2018, issued by the International Searching Authority in counterpart International Patent Application No. PCT/KR2018/006095.

* cited by examiner

ELECTRONIC APPARATUS, METHOD FOR CONTROLLING THEREOF AND THE COMPUTER READABLE RECORDING MEDIUM

CROSS-REFERENCE TO RELATED APPLICATIONS

This application claims priority from Korean Patent Application No. 10-2017-0122546 filed on Sep. 22, 2017, in the Korean Intellectual Property Office, the disclosure of which is incorporated by reference herein in its entirety.

BACKGROUND

1. Field

Devices and methods consistent with what is disclosed herein relate to an electronic apparatus, a controlling method thereof, and a computer readable recording medium, and more particularly, to an electronic apparatus that automatically identifies whether or not an external speaker device is connected, a controlling method thereof, and a computer readable recording medium.

2. Description of the Related Art

Conventionally, audio signals were transmitted through a first channel (mono type), or a second channel (stereo type) through various media and broadcasting. However, multi-channel audio such as 5.1 channel has been developed for providing realistic sound by adding a sense of dimension and realism.

In this regard, it is advantageous for an electronic apparatus that provides an audio signal to detect a connection with an external speaker device. Accordingly, a technique for automatically identifying whether the connection is established when an external speaker device is connected and whether an operation is properly performed, and optimizing audio output environment, has been in high demand.

SUMMARY

It is an aspect to provide an electronic apparatus that automatically identify whether an external speaker device is connected based on an audio signal output from an external speaker device, a controlling method thereof and a computer readable recording medium.

According to an aspect of an exemplary embodiment, there is provided an electronic apparatus, comprising an output circuit configured to be connected to a plurality of speaker devices; an input circuit configured to receive an audio signal; and a processor configured to control the output circuit to cause each of the plurality of speaker devices to output an audio signal, and to identify whether each of the plurality of speaker devices is connected based on the audio signal received through the input circuit.

The processor may be further configured to control the output circuit to cause each of the plurality of speaker devices to output the audio signal with a time difference that falls within a range.

The audio signal may be an audio signal which is different for each of the plurality of speaker devices, and each audio signal may have a different range of at least one of frequency, gain, level and phase.

The processor may be further configured to control the output circuit to cause the plurality of speaker devices to sequentially output the audio signal.

The input circuit may comprise a communication circuit which receives the audio signal from a remote control device that performs communication with the electronic apparatus.

The input circuit may comprise a microphone that receives sound and obtains an audio signal corresponding to the received sound, and the processor may be further configured to identify whether each of the plurality of speaker devices is connected based on the obtained audio signal.

The electronic apparatus may further comprise a display configured to display a connection state of the electronic apparatus with each of the plurality of speaker devices, wherein the processor is further configured to control the display to display at least one of connection information with the plurality of speaker devices, and defect information of a connected speaker device, based on the received audio signal.

The processor may be configured to control the output circuit to transmit, to the connected speaker device, audio output setting information on a speaker device connected to the electronic apparatus based on the received signal.

The output circuit may comprise a plurality of output terminals corresponding to different formats, and the processor may be further configured to control the output circuit to provide the audio signal to one output terminal of the output terminals, and identify whether the one output terminal is connected with the plurality of speaker devices based on the audio signal received through the input circuit.

The format may include at least one of an SPDIF method, an HDMI method, a phone connector method and a USB port method.

According to another aspect of an exemplary embodiment, there is provided a controlling method for an electronic apparatus, the method comprising transmitting an audio signal to each of a plurality of speaker devices connected to the electronic apparatus; receiving an audio signal from each of the plurality of speaker devices; and identifying whether each of the plurality of speaker devices is connected by using the received audio signal from the speaker device.

The transmitting may comprise transmitting the audio signal to each of the plurality of speaker devices with a time difference that falls within a range.

The audio signal may be an audio signal which is different for each of the plurality of speaker devices, and each audio signal may have a different range of at least one of frequency, gain, level, phase.

The transmitting may comprise sequentially transmitting the audio signal by the plurality of speaker devices.

The receiving may comprise receiving the audio signal from a remote control device that performs communication with the electronic apparatus.

The receiving may comprise receiving sound; and obtaining an audio signal corresponding to the received sound, wherein the identifying comprises determining whether each of the plurality of speaker devices is connected based on the obtained audio signal.

The method may further comprise displaying at least one of connection information with the plurality of speaker devices, and defect information of a connected speaker device, based on the received audio signal.

The method may further comprise transmitting to the connected speaker device, audio output information on a speaker device connected to the electronic apparatus based on the received audio signal.

The transmitting may comprise transmitting a different audio signal to each of the plurality of speaker devices in one format of a plurality of formats, and the identifying may comprise identifying whether a speaker device that receives an audio signal in the one format is connected among the plurality of speaker devices based on the received audio signal.

According to another aspect of an exemplary embodiment, there is provided a non-transitory computer readable recording medium storing computer program code which, when executed by a processor, performs operations comprising transmitting an audio signal to each of a plurality of speaker devices connected to an electronic apparatus; receiving an audio signal from each of the plurality of speaker devices; and identifying whether each of the plurality of speaker devices is connected based on the received audio signal from the speaker device.

DETAILED DESCRIPTION

Figure 1:
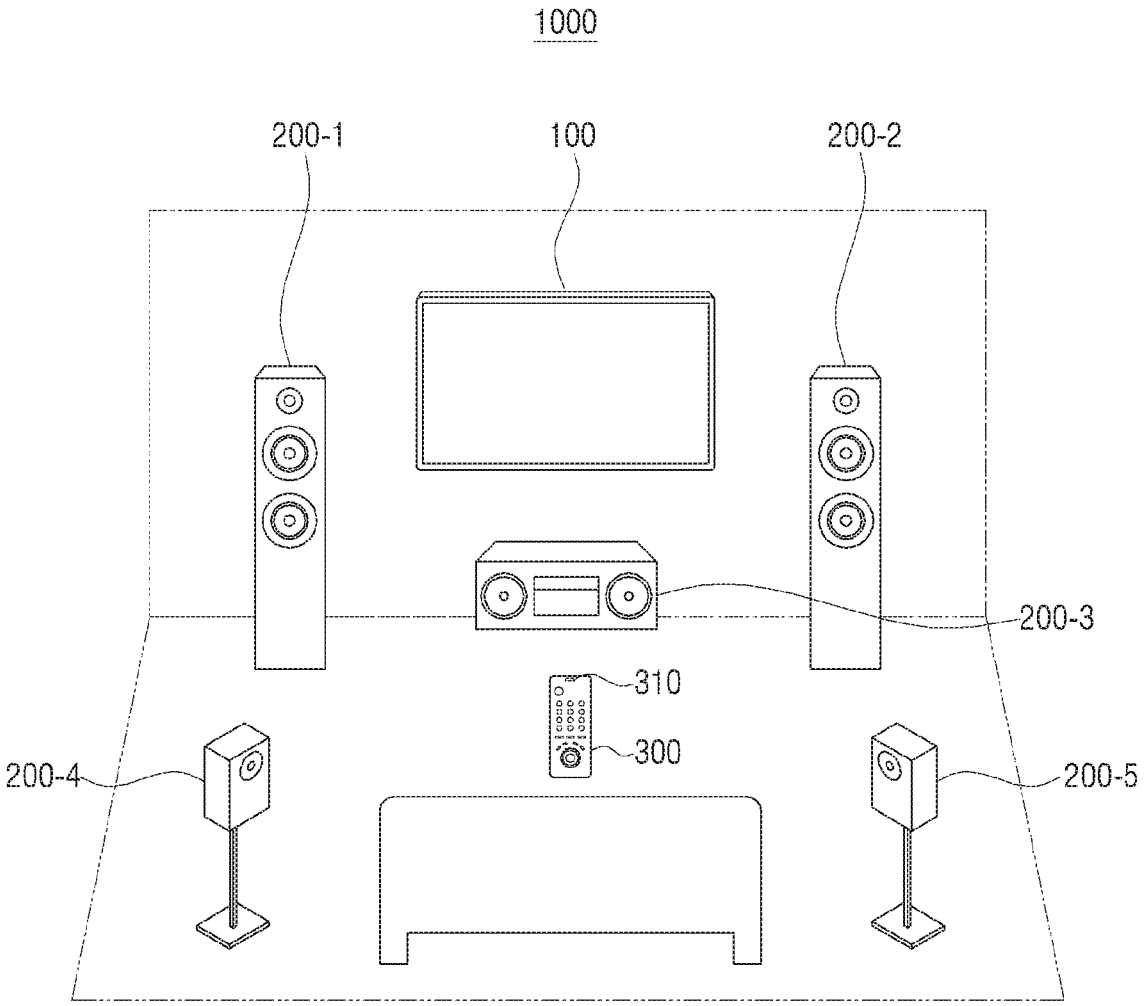
FIG. 1 is a view to explain an audio output system according to an exemplary embodiment.

Hereinafter, exemplary embodiments will be described in detail with reference to the accompanying drawings.

All the terms used in this specification including technical and scientific terms have the same meanings as would be generally understood by those skilled in the related art. However, the meanings of these terms may vary depending on the intentions of the person skilled in the art, legal or technical interpretation, and the emergence of new technologies. In addition, some terms may be arbitrarily selected by the applicant. These terms may be construed in the meaning defined herein and, unless otherwise specified, may be construed on the basis of the entire contents of this specification and common technical knowledge in the art.

The inventive concept is not limited to exemplary embodiments disclosed below and may be implemented in various forms and the scope of the inventive concept is not limited to the following exemplary embodiments. In addition, all changes or modifications derived from the meaning and scope of the claims and their equivalents should be construed as being included within the scope of the present disclosure. In the following description, a configuration which is publicly known but which is irrelevant to the gist of the present disclosure could be omitted.

Terms such as "first," "second," and so on may be used to describe a variety of elements, but the elements should not be limited by these terms. The terms are used simply to distinguish one element from other elements. Also for example, in this specification, the phrase "at least one of A and B" includes "A alone", "B alone", and "both A and B".

When an element is referred to as being "connected" or "coupled" to another element, it can be directly connected or coupled to the another element, or be indirectly connected or coupled to the another element with one or more intervening elements interposed therebetween. In addition, when an element is referred to as "including" a component, this indicates that the element may further include another component instead of excluding another component unless there is different disclosure.

In an exemplary embodiment, 'a module', 'a unit', or 'a part' perform at least one function or operation, and may be realized as hardware, such as a processor or integrated circuit, software that is executed by a processor, or a combination thereof. In addition, a plurality of 'modules', a plurality of 'units', or a plurality of 'parts' may be integrated into at least one module or chip and may be realized as at least one processor except for 'modules', 'units' or 'parts' that should be realized in a specific hardware.

Hereinafter, exemplary embodiments will be described in detail with reference to the accompanying drawings so that those skilled in the art can easily carry out the present inventive concept. However, the present disclosure may be embodied in many different forms and is not limited to the exemplary embodiments described herein. In order to clearly illustrate the present disclosure in the drawings, some of the elements that are not essential to the complete understanding of the disclosure are omitted for clarity, and like reference numerals refer to like elements throughout the specification.

In the related art, an electronic apparatus may be equipped with a mechanical configuration at a portion engaged with an external speaker device and may detect a connection with an external speaker device by converting a physical operation of the mechanical configuration caused by engagement with the external speaker device into an electrical signal.

However, detecting a cable connection through the mechanical configuration has a problem in that even if a connected speaker device is not supplied with power or an audio output operation is not performed properly due to a defective cable connection, the external speaker device may be determined to be properly connected by the physical operation of the mechanical configuration.

In addition, there is an inconvenience where a user operates the settings of the external speaker device for optimized audio output environment when the external speaker device is connected.

Exemplary embodiments described below address these and other problems with the related art.

Hereinafter, exemplary embodiments will be described in more detail with reference to the drawings.

FIG. 1 is a view to explain an audio output system consisting of a plurality of speaker devices according to an exemplary embodiment.

Referring to FIG. 1, an audio output system 1000 according to an exemplary embodiment may include an electronic apparatus 100, a plurality of speaker devices 200-1, 200-2, 200-3, 200-4 and 200-5 and a remote control device 300.

The electronic apparatus 100 may transmit audio signals of an input image to a connected speaker device. For example, the electronic apparatus 100 may include a set-top box and a display device such as PC, TV, mobile device, etc. The electronic apparatus 100 may transmit audio signals to the plurality of speaker devices 200-1, 200-2, 200-3, 200-4 and 200-5 to identify whether the electronic apparatus is connected to an external speaker device. The transmitted audio signals may be test sound for determining connectivity.

The electronic apparatus 100 may transmit audio signals to the respective plurality of speaker devices 200-1, 200-2, 200-3, 200-4 and 200-5. The audio signals may be predetermined and/or may be the same. The electronic apparatus 100 may sequentially transmit the audio signals to the plurality of speaker devices 200-1, 200-2, 200-3, 200-4 and 200-5

The audio signals may be different for each of the plurality of speaker devices 200-1, 200-2, 200-3, 200-4 and 200-5. In this case, the electronic apparatus 100 may generate a different plurality of audio signals each having a different range of at least one of frequency, gain, level and phase of an audio signal.

The electronic apparatus 100 may transmit audio signals so that the plurality of speaker devices 200-1, 200-2, 200-3, 200-4 and 200-5 output different audio signals with a time difference that falls within a range. The range may be predetermined. Advantageously, the electronic apparatus 100 may transmit audio signals so that the plurality of speaker devices 200-1, 200-2, 200-3, 200-4 and 200-5 output different audio signals at the same time.

The electronic apparatus 100 may transmit audio signals in different formats to an external speaker device. The electronic apparatus 100 may simultaneously transmit audio signals in different formats, or sequentially transmit the audio signals by changing the format. The plurality of formats may be an SPDIF method, an HDMI method, a phone connector method, a USB port method, a Wi-Fi method, a Bluetooth method, and the like.

The electronic apparatus 100 may receive audio signals. The electronic apparatus 100 may receive an audio signal output from the external speaker device right after transmitting an audio signal to the external speaker device. The electronic apparatus 100 may be equipped with a microphone and obtain an audio signal by directly receiving sound from an external source with the microphone. The electronic apparatus 100 may receive an audio signal from a separate external device. The electronic apparatus 100 may receive an audio signal from a remote control device 300 which is connected to the electronic apparatus 100. An audio signal received from the remote control device 300 may be input through a microphone 310 provided in the remote control device 300.

The electronic apparatus 100 may determine whether the plurality of speaker devices 200-1, 200-2, 200-3, 200-4 and 200-5 are connected by using the input audio signals. The electronic apparatus 100 may determine whether each of the plurality of speaker devices 200-1, 200-2, 200-3, 200-4 and 200-5 is connected by comparing the audio signals transmitted to the plurality of speaker devices 200-1, 200-2, 200-3, 200-4 and 200-5 with the input audio signals.

The electronic apparatus 100 may transmit output setting information for audio output environment optimization to a connected speaker device.

The plurality of speaker devices 200-1, 200-2, 200-3, 200-4 and 200-5 may be connected through the same network, and operate in association with each other, or independently of each other.

The audio output system 1000 may include front speakers 200-1 and 200-2 disposed on the front left and front right sides of a user, respectively, a center speaker 200-3 disposed between the front speakers, and rear speakers 200-4 and 200-5 disposed on the back left and back right sides of a user, respectively.

Some of the elements may be omitted or a new element may be added according to a usage purpose of the audio output system 100. If a user intends to listen to music, the audio output system 1000 may further include a replay device, etc. for replaying music, and the center speaker 200-3 which is not suitable for listening to music may be excluded. If a user intends to watch a movie, the audio output system 1000 may further include a speaker included in a display apparatus, and the display apparatus may be regarded as one of the plurality of speaker devices. In the case of home theater, the audio output system 1000 may further include a video replay device such as a display apparatus, a DVD replay device, a surround speaker, a woofer, etc. FIG. 1 shows that an external speaker constitutes 5.1 channel, but the present disclosure is not limited thereto. For example, the present disclosure may also be applied to 7.1 channel, or other arrangements where it is advantageous to determine connectivity of devices.

Figure 2:
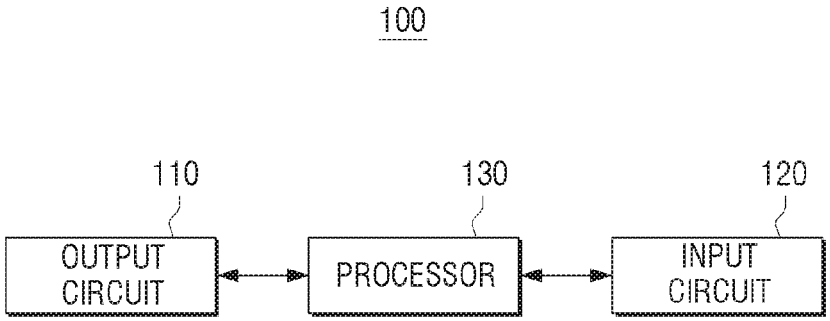
FIG. 2 is a schematic block diagram to explain a configuration of an electronic apparatus of the audio output system shown in FIG. 1.

FIG. 2 is a schematic block diagram to explain configuration of an electronic apparatus constituting the audio output system shown in FIG. 1.

Referring to FIG. 2, an electronic apparatus 100 may include an output circuit 110, an input circuit 120 and a processor 130.

The output circuit 110 may be connected to a plurality of speaker devices. The output circuit 110 may be an integrated circuit or may be a processor coded with computer program code for performing one or more functions associated with the output circuit 110. The output circuit 110 may be connected to the plurality of speaker devices in a wired/wireless manner. When the output circuit 110 is connected to the plurality of speaker devices in a wired manner, the output circuit 110 may be an output terminal where the cables of the plurality of speaker devices are engaged. When the output circuit 110 is connected to the plurality of speaker devices in a wireless manner, the output circuit 110 may be a communication circuit that performs wireless communication (not shown).

The output circuit 110 may output an audio signal to each of the plurality of speaker devices. The output audio signal may be test sound for confirming whether each of the plurality of speaker devices is connected. The output circuit 110 may transmit the same audio signal to the plurality of speaker devices sequentially. Alternatively, the output circuit 110 may transmit a different audio signal to each of the plurality of speaker devices. The output circuit 110 may transmit a plurality of audio signals each having a different range of at least one of frequency, gain, level and phase to the respective plurality of speaker devices. The output circuit 110 may transmit the plurality of audio signals having different formats to the respective plurality of speaker devices. The formats may be at least one of an SPDIF method, an HDMI method, a phone connector method, a USB port method, a Wi-Fi method, a Bluetooth method, and the like.

The input circuit 120 may receive audio signals. The input circuit 120 may be an integrated circuit or may be a processor coded with computer program code for performing one or more functions associated with the input circuit 120. The input circuit 120 may include a microphone that directly receives sound from an external source. The input circuit 120 may further include a communication circuit that receives audio signals from a connected external device. The external device may be a remote control device connected to the electronic apparatus 100.

The processor 130 may determine whether an external speaker device is connected by using the output audio signal and the input audio signal. The processor 130 may be a one or more microprocessors and may be coded with computer program code to perform one or more functions associated with the processor 130.

The processor 130 may control the output circuit 110 to output audio signals. The processor 130 may control the output circuit 110 to sequentially transmit the same audio signal to the plurality of speaker devices, or to output a different audio signal for each of the plurality of speaker devices. When the output circuit 110 outputs a different audio signal for each of the plurality of speaker devices, the processor 130 may control the output circuit 110 to output a plurality of audio signals each having a different range of at least one of frequency, gain, level and phase. The different formats of the audio signals may be the same. A speaker embedded in the electronic apparatus 100 may be set to a mute state. An exemplary embodiment for outputting a different audio signal for each of the plurality of speaker devices will be detailed below.

For example, the processor 130 may control the output circuit 110 to output a plurality of audio signals in an SPDIF method having different frequency ranges. The processor 130 may transmit an audio signal having a frequency range A to a left side front speaker, a frequency range B to a right side front speaker, a frequency range C to a center speaker, a frequency range D to a left side rear speaker, and a frequency range E to a right side rear speaker.

The information on ranges of frequency, gain, level and phase of an audio signal to be transmitted to each speaker may be pre-stored in a memory of the electronic apparatus (not shown), or received from an external server through a communication circuit (not shown).

When at least one of the input audio signals through the input circuit 120 is matched with at least one of the output audio signals, the processor 130 may determine that the matched audio signal is connected to the electronic apparatus to which the audio signal is transmitted. For example, when a plurality of audio signals input through the input circuit 120 correspond to the frequency ranges A, B, D and E, the processor 130 may determine that the left and right front speakers and left and right rear speakers are connected, and that the center speaker is not connected.

The processor 130 may control the output circuit 110 to output different audio signals with a time difference that falls within a range. The range may be predetermined. The processor 130 may control the output circuit 110 to output different audio signals at the same time.

As described above, whether each of the plurality of speaker devices is connected may be determined although test sound is output from a plurality of speaker devices at the same time since different audio signals are transmitted to the respective plurality of speaker devices.

As described above, whether the plurality of speaker devices are connected may be determined by transmitting different audio signals to the plurality of speaker devices. However, in actual implementation, whether each of the plurality of speaker devices is connected may be determined by alternately transmitting one of the different audio signals and receiving an audio signal output from the speaker device.

The processor 130 may determine whether the speaker determined to be connected based on the audio signal input through the input circuit 120 operates properly. The processor 130 may determine whether the connected speaker device properly operates by comparing the audio signal output through the output circuit 110 with the audio signal input through the input circuit 120.

The processor 130 may, when an audio signal is provided to the connected speaker device, but a corresponding audio signal is not input through the input circuit 120, determine that the connected speaker device does not properly operate by using pre-stored connection information. The processor 130 may transmit an audio signal having a frequency and gain and compare the audio signal input through the input circuit 120 with the transmitted audio signal. The frequency and gain may be predetermined. If it is determined that the input audio signal and the transmitted audio signal have the same frequency but different gain, the processor 130 may determine that the speaker device may be connected, but the speaker may be defective or incorrectly set.

The processor 130 may display at least one of the connectivity information of the speaker and information on whether the speaker properly operates on a display (not shown) and provide the information to a user. The processor 130 may control the display (not shown) to display information about a speaker which does not properly operate, or to display information about options to fix the problem if the speaker does not properly operate. The above-described operation will be detailed with reference to FIGS. 7A and 7B.

The processor 130 may analyze the audio signal input through the input circuit 120 and identify information on the connected speaker device. The processor 130 may analyze the audio signal input through the input circuit 120 and identify, for example, a manufacturer, a product name, and tuning information of the connected speaker device.

For example, the processor 130 may control the output circuit 110 so that each of the plurality of speaker devices outputs a different audio signal in a different frequency range such as a first audio signal having a melody of 'Do Re Mi Fa So La Si Do', and a second audio signal having a melody of 'Do Re Mi Fa So La Si Do' one octave higher than that of the first audio signal described above.

When the audio signals are input through the input circuit 120, the processor 130 may analyze audio signals with respect to the first audio signal and the second audio signal, extract the characteristic part and identify the type of speaker that outputs an audio signal based on the extracted characteristic part. The processor 130 may compare pre-stored information on the plurality of speaker devices and the characteristic part extracted from the input audio signal and identify the type of connected speaker device. The pre-stored information on the plurality of speaker devices may be received from an external server through a communication circuit (not shown).

The processor 130 may request information on the connected speaker device and identify the type of connected speaker device based on the information received from the speaker device.

The processor 130 may transmit output setting information for embodying optimized audio output environment to a plurality of speaker devices based on the types of the connected plurality of speaker devices.

According to another exemplary embodiment, the processor 130 may control the output circuit 110 to output a plurality of audio signals in different formats. The processor 130 may control the output circuit 110 to sequentially output the audio signals in different formats. The audio output format may be one of an SPDIF method, an HDMI method, a phone connector method, a USB port method, a Wi-Fi method and a Bluetooth method.

The processor 130 may output a different plurality of audio signals in one format, and when the audio signal input through the input circuit 120 is matched with the output audio signal, determine that an output terminal corresponding to the matched audio signal in the format is connected to at least one of the speaker devices. The description thereof will be made with reference to FIG. 8 below.

It is described that a plurality of audio signals in different formats are sequentially output, but audio signals in different formats may be output at the same time in another exemplary embodiment.

As described above, the processor 130 is described as a single processor, but when the present disclosure is embodied, the processor 130 may embodied with one or more processors. The processor 130 may control the output circuit so that a first processor may provide an audio signal in one format to a second processor, and the second processor may generate different audio signals to be output from respective speaker devices.

The identification of the external speaker device may be performed when the electronic apparatus 100 is changed from a power-off state to a power-on state by a user operation. When the electronic apparatus 100 is connected to a plurality of speaker devices in a wireless manner and a power-on command is input in a power off state, the electronic apparatus 100 may perform pairing with peripheral speaker devices. The electronic apparatus 100 may transmit an audio signal for test to a paired speaker device.

The identification of the external speaker device may be performed at a timing, apart from when a power-off state is changed to a power-on state, or performed every time an operation command for replaying contents to be output to the external speaker device is input. The timing may be predetermined.

Figure 3:
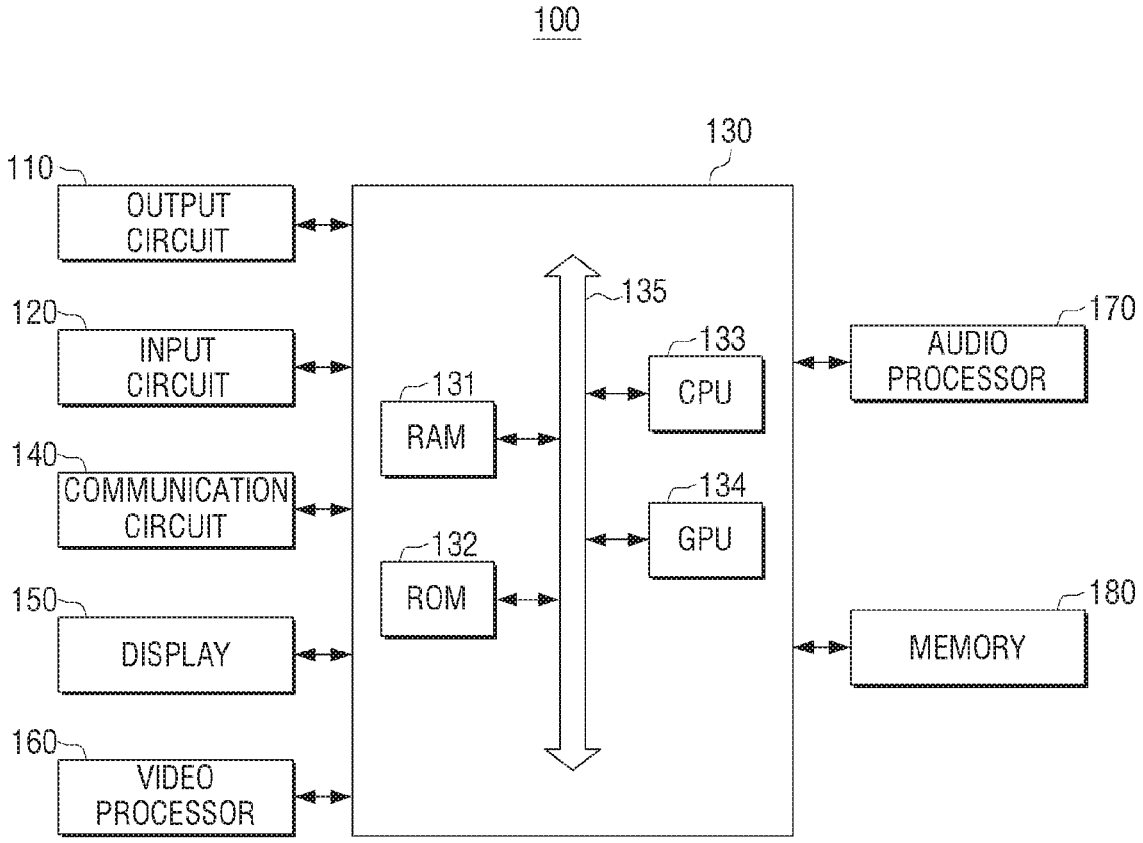
FIG. 3 is a detailed block diagram illustrating a configuration of the electronic apparatus shown in FIG. 2.

FIG. 3 is a detailed block diagram illustrating configuration of the electronic apparatus shown in FIG. 2.

Referring to FIG. 3, an electronic apparatus 100 may include an output circuit 110, an input circuit 120, a processor 130, a communication circuit 140, a display 150, a video processor 160, an audio processor 170, and a memory 180.

The output circuit 110 may output an audio signal to at least one of a speaker embedded in the electronic apparatus 100 and a plurality of connected external speaker devices. The output circuit 110 may output the audio signal which is audio processed by the audio processor 170 to the plurality of external speaker devices and at least one of the speakers embedded in the electronic apparatus 100. The output circuit 110 may be connected to the plurality of external speaker devices in a wired/wireless manner. When the electronic apparatus 100 is connected to the plurality of speaker devices in a wired manner, the output circuit 110 may include a plurality of audio output terminals corresponding to a plurality of formats, respectively. For example, the audio output terminal may use at least one of an SPDIF method, an HDMI method, a phone connector method, a USB port method, a Wi-Fi method and a Bluetooth method.

When the electronic apparatus 100 is connected to the plurality of external speaker devices in a wireless manner, the output circuit 110 may output an audio signal to the external speaker device through at least one of a Bluetooth method and a Wi-Fi method. When the electronic apparatus 100 is connected to the external speaker device in a wireless manner, the communication circuit 140 may function as the output circuit 110.

The input circuit 120 may receive audio signal from outside the electronic apparatus 100. The input circuit 120 may be provided in the electronic apparatus 100, receive sound from an external source, and further include a microphone that generates an audio signal corresponding to the input sound. The input circuit 120 may be defined by a stereo microphone that receives sound inputs at a plurality of positions.

It is described that the input circuit 120 is limited to a microphone, but when a microphone is not provided in the electronic apparatus 100, or by the setting, the communication circuit 140 that receives audio signals from an external device may function as the input circuit 120. The external device that transmits audio signals to the electronic apparatus 100 may be a remote control device connected to the electronic apparatus 100.

The processor 130 may include a RAM 131, a ROM 132, a CPU 133, a GPU (Graphic Processing Unit) 134, and a bus 135. The RAM 131, the ROM 132, the CPU 133, the GPU (Graphic Processing Unit) 134, and the like may be connected to each other via the bus 135.

The CPU 133 may access the memory 180 and perform booting using the O/S stored in the memory 180. Various operations may be performed using various programs, contents, data, and the like stored in the memory 180.

The ROM 132 may store a command set for system booting. When a turn-on command is input and power is supplied, the CPU 133 may copy the O/S stored in the memory 180 to the RAM 131 according to a command stored in the ROM 132, execute the O/S and perform system booting. When the system booting is completed, the CPU 133 may copy various programs stored in the memory 180 to the RAM 131, execute the program copied to the RAM 131, and perform various operations.

When the booting of the electronic apparatus 100 is completed, the GPU 134 may display a UI on the display 150. Specifically, the GPU 134 may generate a screen including various objects such as icons, images, and texts using a calculation unit (not shown) and a rendering unit (not shown). The calculation unit may calculate attribute values such as coordinate values, shapes, sizes, and colors of the respective objects to be displayed according to the layout of the screen. The rendering unit may generate screens of various layouts including objects based on the attribute values calculated by the calculation unit. The screen (or user interface window) generated by the rendering unit may be provided to a display, and displayed in a main display area and a sub-display area. In the above description, an image processing operation according to the present disclosure may be performed by the GPU 134. However, in actual implementation, the image processing operation may be performed by the CPU 133 or the GPU 134.

The communication circuit 140 may perform communication with various types of external devices according to various types of communication methods. The communication circuit 140 may be an integrated circuit or may be a processor coded with computer programming code to perform one or more functions of the communication circuit 140. The communication circuit 140 may perform communication with an external device such as a remote control device, an external server, an external speaker device, etc.

The communication circuit 140 may receive video signals and audio signals from an external device in a wired manner using antenna, cable or port, or in a wireless communication method such as a Wi-Fi method, a Bluetooth method, etc.

When the electronic apparatus 100 is capable of wired communication, the communication circuit 140 may use at least one of an SPDIF method, an HDMI method, a phone connector method, a USB port method, a Wi-Fi method and a Bluetooth method.

When the electronic apparatus 100 is capable of wireless communication, the communication circuit 140 may include a Wi-Fi chip, a Bluetooth chip, a wireless communication chip, and an NFC chip. Specifically, the Wi-Fi chip and the Bluetooth chip may perform communication using the Wi-Fi method and the Bluetooth method, respectively. When a Wi-Fi chip or a Bluetooth chip is used, various connectivity information such as an SSID and a session key may be transmitted and received first, communication connection may be established based on the connectivity information, and various information may be transmitted and received. The communication chip may refer to a chip that performs communication according to various communication standards such as IEEE, ZigBee, 3rd Generation (3G), 3rd Generation Partnership Project (3GPP), Long Term Evolution (LTE), etc. The NFC chip may refer to a chip operating in an NFC (Near Field Communication) system using 13.56 MHz band among various RF-ID frequency bands such as 135 kHz, 13.56 MHz, 433 MHz, 860 to 960 MHz and 2.45 GHz.

The display 150 may display connection states of the electronic apparatus 100 and the plurality of speaker devices. The display 150 may display the connection states of the electronic apparatus 100 and the plurality of speaker devices and whether the connected plurality of speaker devices properly operate.

The display 150 may be implemented as various types of displays such as a Liquid Crystal Display (LCD), an Organic Light Emitting Diodes (OLED) display, a Plasma Display Panel (PDP), and the like. A driving circuit, a backlight unit, and the like, which can be implemented in the form of a-si TFT, low temperature poly silicon (LTPS) TFT, OTFT (organic TFT), or the like may be included in the display. The display may be embodied as a flexible display. When the electronic apparatus 100 perform signal processing like a set-top box, the display 150 may be omitted, and although the display 150 is provided, a mere message function may be available such as alarming.

The video processor 160 may process video data included in a content received through the communication circuit 140 or a content stored in the memory 180 when the display 150 is provided in the electronic apparatus 100. The video processor 160 may perform various image processing such as decoding, scaling, noise filtering, frame rate conversion, resolution conversion, and the like on the video data.

The audio processor 170 may generate a plurality of different audio signals each having a different range of at least one of frequency, gain, level, and phase under the control of the processor 130. The different plurality of audio signals may be one or more test sounds for confirming whether or not the plurality of speaker devices are connected and whether the speaker devices properly operate.

The audio processor 170 may generate a plurality of audio signals having different formats under the control of the processor 130. The format may be at least one of an SPDIF method, an HDMI method, a phone connector method, a USB port method, a Wi-Fi method, and a Bluetooth method.

The audio processor 170 may be a constituent element for processing audio data included in contents received through the communication circuit 140 or contents stored in the memory 180. The audio processor 170 may perform various image processing for audio data such as decoding, amplification, noise filtering, etc.

The memory 180 may be implemented as a storage medium in the electronic apparatus 100 and an external storage medium, for example, a removable disk including a USB memory, a Web server via a network, or the like. The memory 180 may include a hard disk, an SSD, a memory card, a ROM, a USB memory, and the like.

The memory 180 may include information such as a frequency range, a gain range, a level range, a phrase range, etc. of an audio signal to be transmitted to each of the plurality of external speaker devices. For example, the memory 180 may store information on the test sound to be transmitted to each of the plurality of speaker devices constituting 5.1 channel.

The memory 180 may store information on the plurality of speaker devices. The information on the plurality of speaker devices may include manufacturers, brand names, tuning setting information of the speaker devices.

The information on the audio signals and the speaker devices may be stored in a manufacturing process of the electronic apparatus, or received from an external server through the communication circuit 140.

The memory 180 may store connection information with an external speaker device determined by the processor 130, and information on whether the connected external speaker device properly operates. The memory 180 may update the information stored under the control of the processor 130 when the connection information or information on whether the speaker device properly operates is changed.

Figure 4:
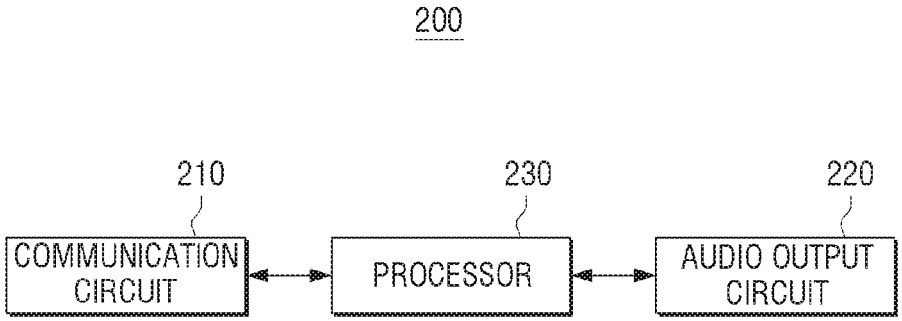
FIG. 4 is a block diagram to explain a configuration of a speaker device of the audio output system as shown in FIG. 1.

FIG. 4 is a block diagram to explain configuration of a speaker device constituting the audio output system as shown in FIG. 1.

A speaker device 200 may include a communication circuit 210, an audio output circuit 220 and a processor 230.

The communication circuit 210 may perform communication with various types of external devices according to various types of communication methods. The communication circuit 210 may be an integrated circuit or may be a processor coded with computer program code to perform one or more functions of the communication circuit 210. The communication circuit 210 may perform communication with external devices such as an electronic apparatus, a remote control device, an external server, etc.

The communication circuit 210 may receive audio signals according to a wired communication method using an SPDIF port, an HDMI port, a phone connecter, a USB port, or the like, or a wireless communication method such as a Wi-Fi method, a Bluetooth method, etc.

The communication circuit 210 may receive setting information on audio output from the electronic apparatus.

The audio output circuit 220 may output the audio signal received through the communication circuit 210 by sound. The audio output circuit 220 may be an integrated circuit or may be a processor coded with computer program code to perform one or more functions of the audio output circuit 2220. The audio signal received through the communication circuit 210 may be test sound to identify whether the speaker device is connected to the electronic apparatus.

In response to receiving an audio signal through the communication circuit 210, the processor 230 may control the audio output circuit 220 to audio process the received audio signal and output the processed audio signal by sound.

In response to receiving the setting information on audio output through the communication circuit 210, the processor 230 may control audio output setting of the speaker device 200 based on the received setting information. The received setting information may be received from the remote control device connected to the electronic apparatus or the speaker device 200.

In response to receiving a request for information on the speaker device 200 from the electronic apparatus through the communication circuit 210, the processor 230 may control the communication circuit 210 to transmit information such as a manufacturer, a brand name, tuning information, etc. to the electronic apparatus.

Figure 5:
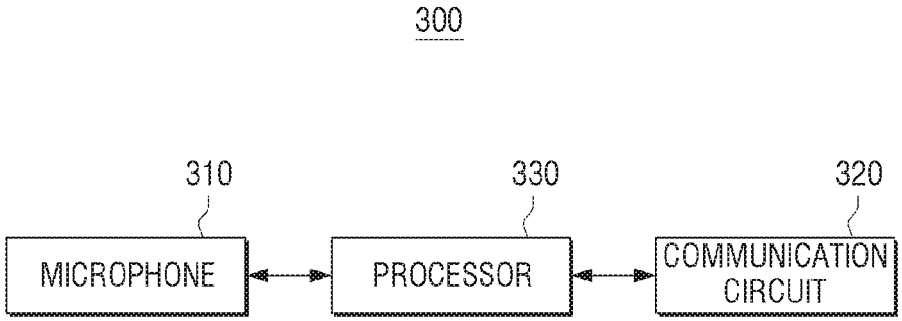
FIG. 5 is a block diagram to explain a configuration of a remote control device of the audio output system as shown in FIG. 1.

FIG. 5 is a block diagram to explain configuration of a remote control device constituting the audio output system as shown in FIG. 1.

A remote control device 300 may include a microphone 310, a communication circuit 320 and a processor 330.

The microphone 310 may receive audio signals from outside the remote control device 300. The microphone 310 may be mounted on the remote control device 300, receive sound from an external source and generate an audio signal corresponding to the input sound. The microphone 310 may be defined by a stereo microphone that receives sound inputs at a plurality of positions of the remote control device 300.

The communication circuit 320 may perform communication with various types of external apparatuses according to various types of communication methods. The communication circuit 320 may be an integrated circuit or may be a processor coded with computer program code to perform one or more functions of the communication circuit 320. The communication circuit 320 may perform communication with external devices such as an electronic apparatus, an external server, a speaker device, etc. using a wireless communication method such as a Wi-Fi communication method, a Bluetooth communication methods, etc.

For example, when the remote control device 300 is connected to the electronic apparatus, the communication circuit 320 may transmit a control command for the electronic apparatus according to a user operation.

The communication circuit 320 may transmit audio signals generated by the microphone 310 to the electronic apparatus. The audio signals may be generated based on the sound output from the speaker device. The sound output through the speaker device may be the audio signals output from the electronic apparatus.

When the remote control device 300 is connected to the speaker device, the communication circuit 320 may transmit a control command for the speaker device to the electronic apparatus according to a user operation.

The processor 330 may control each element of the remote control device 300. When a user inputs a command through a button or a touch screen provided in the remote control device 300, the processor 330 may control the communication circuit 310 to transmit a control command corresponding to the input command to the connected external device.

The processor 330 may control the communication circuit 320 to transmit the audio signals generated by the microphone 310 to the electronic apparatus.

As described above, the electronic apparatus may determine whether the speaker device is connected without a microphone, by receiving audio signals with regard to the sound output from the speaker device by using a microphone provided in the remote control device.

Figure 6:
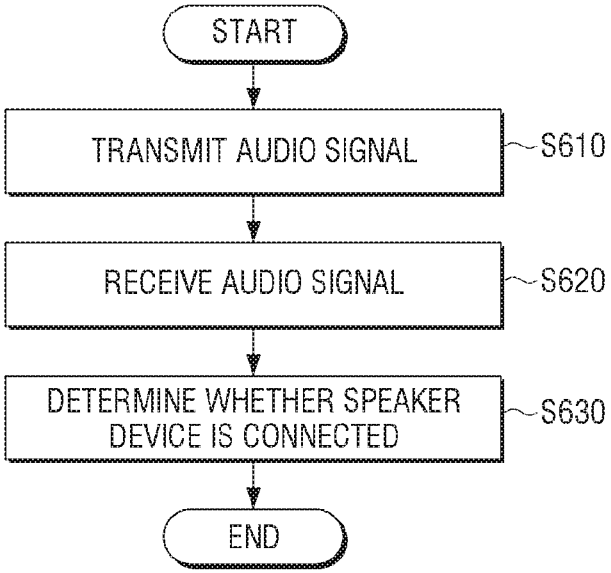
FIG. 6 is a flowchart to explain a method of an electronic apparatus for identifying an external speaker device according to an exemplary embodiment.

FIG. 6 is a flowchart to explain a method of an electronic apparatus for identifying an external speaker device according to an exemplary embodiment.

Referring to FIG. 6, an electronic apparatus may transmit audio signals to a plurality of speaker devices at step S610. The audio signals may be predetermined. In response to receiving a power-on command while being in a power-off state, the electronic apparatus may output different audio signals. The electronic apparatus may output different audio signals when a power button provided in the electronic apparatus is operated, or a power-on command is received through a remote control device connected to the electronic apparatus.

The audio signals may be different audio signals for the plurality of speaker devices, or may be the same audio signal. The electronic apparatus may transmit the different audio signals simultaneously or sequentially to the plurality of speaker devices, or transmit the same audio signal sequentially to the plurality of speaker devices. When the different audio signals are transmitted to the respective plurality of speaker devices, the electronic apparatus may transmit the plurality of audio signals each having a different range of frequency, gain, level and phase so that each of the plurality of electronic apparatuses outputs a different audio signal.

The electronic apparatus may output different audio signals with a time difference that falls within a predetermined range. The electronic apparatus may simultaneously output different audio signals The electronic apparatus may receive audio signals at step S620. The electronic apparatus may receive audio signals from an external source right after transmitting different audio signals. The electronic apparatus may receive audio signals output from the external speaker device right after transmitting audio signals to the external speaker device.

The audio signal may be generated based on the sound input through the microphone provided in the electronic apparatus, or received from the external device connected to the electronic apparatus. The external device connected to the electronic apparatus may be the remote control device including a microphone.

The electronic apparatus may determine whether the electronic apparatus is connected to the speaker device at step S630. The electronic apparatus may determine whether the electronic apparatus is connected to the external speaker device by using the input audio signal. When at least one of the output audio signals is matched with the input audio signal, the electronic apparatus may determine that the electronic apparatus may be connected to the speaker device to which the audio signal is transmitted.

As described above, the electronic apparatus may determine whether the electronic apparatus is connected to each of the plurality of speaker devices although the test sounds are simultaneously output from the plurality of speaker devices since the plurality of speaker devices transmit respective audio signals.

The electronic apparatus may determine whether the connected speaker device properly operates by using the input audio signals. By using the pre-stored connection information, when an audio signal is provided to the connected speaker device, and a corresponding audio signal is not input to the electronic apparatus, the electronic apparatus may determine that the connected speaker device is disconnected, or does not properly operate. When the output audio signal does not exactly match the input audio signal, it may be determined that the electronic apparatus is connected the speaker device to which the audio signal is transmitted, but there may be abnormalities in the connected speaker device, or an output setting therein may be incorrectly set.

When the display is provided, the electronic apparatus may display a result of determining whether the external speaker device is connected and properly operates on the display. A user interface (UI) screen that provides the determination result to a user will be described in detail with reference to FIGS. 7A and 7B.

The electronic apparatus may transmit audio output setting information with regard to the connected plurality of speaker devices to respective speaker devices according to whether the plurality of electronic apparatuses are connected and whether the plurality of electronic apparatuses properly operate.

As described above, an optimized audio output environment may be provided automatically without a user operation by identifying the connected external speaker device, thereby enhancing user convenience.

Figure 7A:
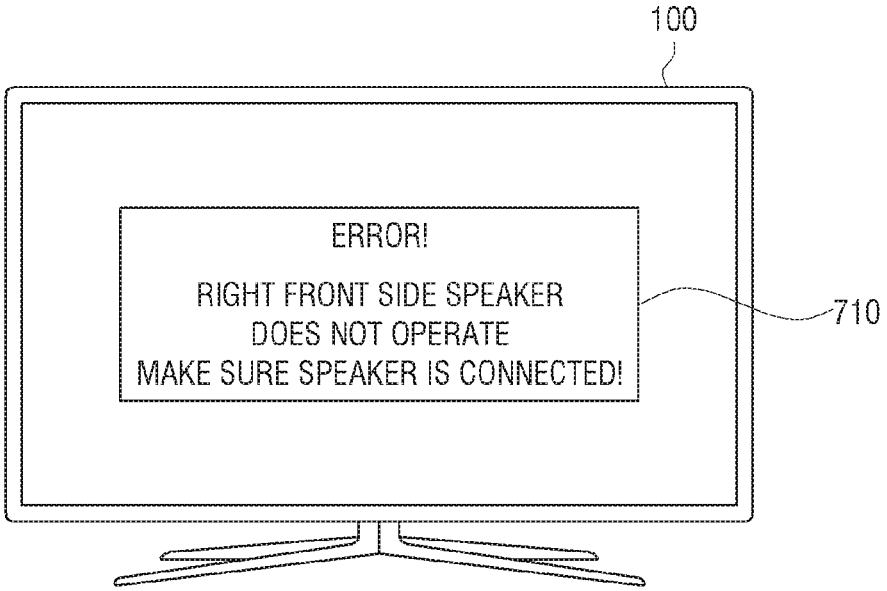
FIGS. 7A and 7B are views illustrating various exemplary embodiments of a user interface (UI) screen that shows a connection state with an external speaker device.
Figure 7B:
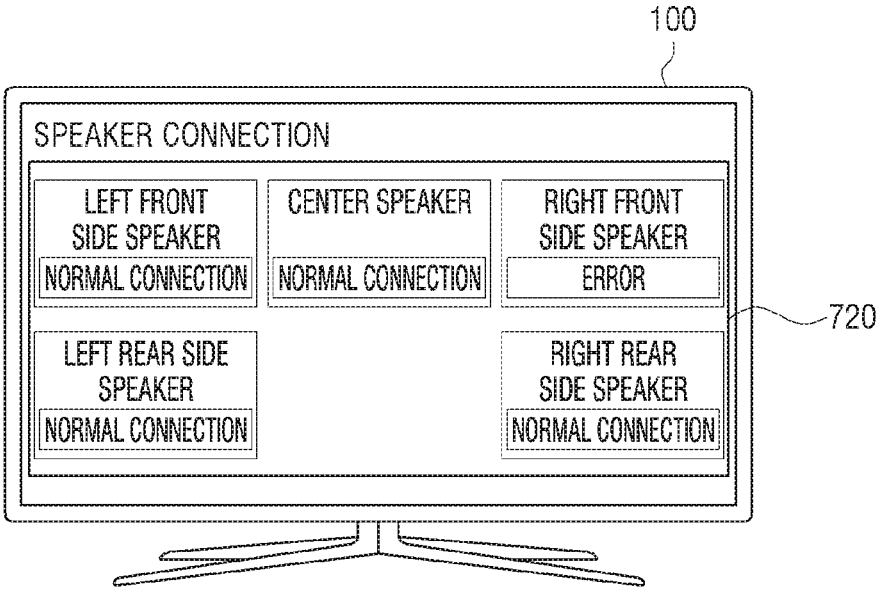

FIGS. 7A and 7B are views illustrating various exemplary embodiments of a UI screen that shows a connection state with an external speaker device.

The electronic apparatus 100 may transmit test sound each of the plurality of speaker devices constituting 5.1 channel. The electronic apparatus 100 may transmit different audio signals to left and right front speakers, a center speaker, and left and right rear speakers.

The electronic apparatus 100 may receive audio signals corresponding to the sound output from the plurality of speaker devices. When an audio signal is not input to the right front speaker, the electronic apparatus 100 may determine that the right front speaker is disconnected or does not properly operate.

To provide such determination result to a user, the electronic apparatus 100 may provide a UI screen as shown in FIGS. 7A and 7B to a user. When a display is provided in the electronic apparatus 100, the electronic apparatus may display a UI screen on the display. When the display is not provided in the electronic apparatus 100, the electronic apparatus 100 may transmit data so that the external device including the display may display the UI screen.

As shown in FIG. 7A, the electronic apparatus 100 may display a UI screen 710 including information on a speaker device where an error occurs. As shown in FIG. 7B, the electronic apparatus 100 may display a UI screen 720 including information on the plurality of speaker devices connected to the electronic apparatus 100 and information on a speaker device where an error occurs among the connected plurality of speaker devices. In this case, the electronic apparatus 100 may display information on whether the connected speaker devices properly operate or options to fix the problem if the speaker does not properly operate. Meanwhile, FIG. 7B shows information on the connected plurality of speaker devices in consideration of arrangement of the connected plurality of speaker devices, but when the present disclosure is embodied, information on the connected plurality of speaker devices may be displayed in various manners such as being displayed in a list.

As described above, a user may easily identify the problem regarding audio output and solve the problem since the electronic apparatus automatically identifies whether the external speaker device is connected and properly operates.

Figure 8:
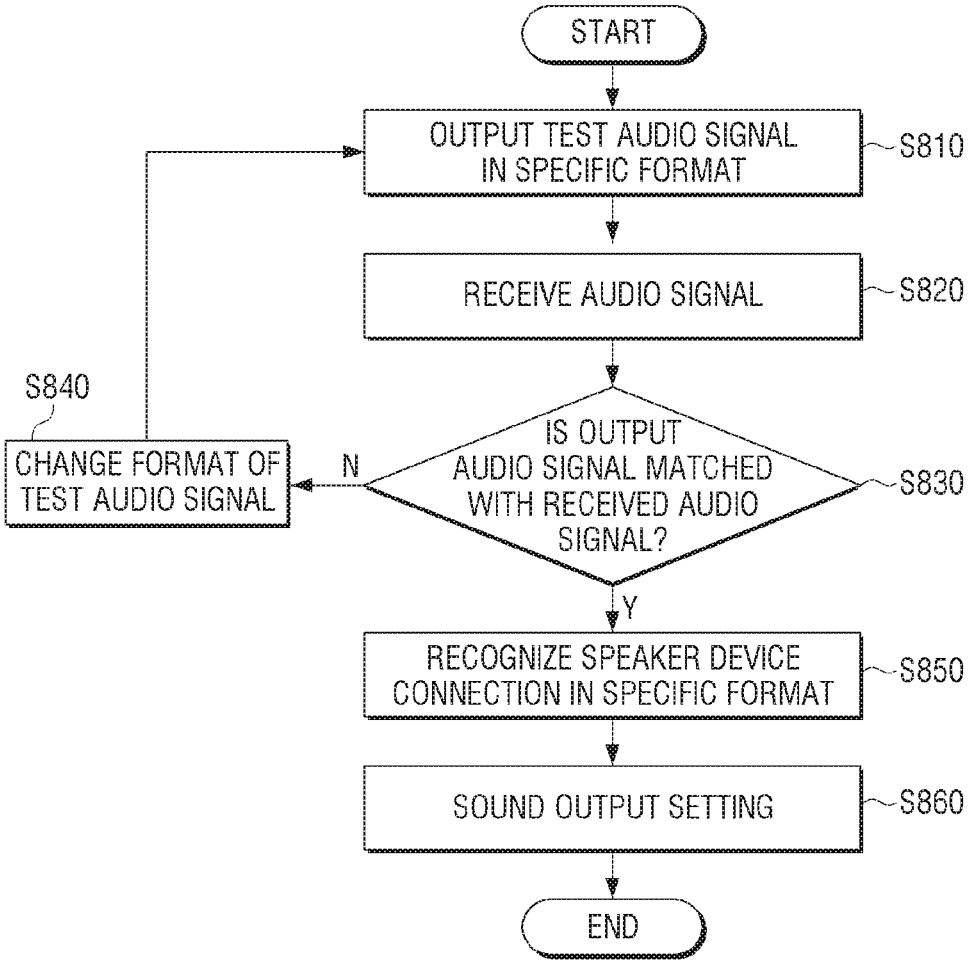
FIG. 8 is a flowchart to explain a method of an electronic apparatus for identifying an external speaker device according to another exemplary embodiment.

FIG. 8 is a flowchart to explain a method of an electronic apparatus for identifying an external speaker device according to another exemplary embodiment.

The electronic apparatus may output a test audio signal in a specific format at step S810. Although not shown, in response to receiving a power-on command while being in a power-off state, the electronic apparatus may output a test audio signal. The electronic apparatus may output a test audio signal when a power button provided in the electronic apparatus is operated, or a power-on command is received through the remote control device connected to the electronic apparatus.

The electronic apparatus may output different test audio signals in a specific format. The electronic apparatus may determine whether each of the plurality of speaker devices that receives an audio signal in a specific format is connected. The specific format may use at least one of an SPDIF method, a HDMI method, a phone connector method, a USB port method, a Wi-Fi method and a Bluetooth method.

The electronic apparatus may receive an audio signal at step S820. The electronic apparatus may receive one or more audio signals from outside the electronic apparatus. The electronic apparatus may directly receive sound through a microphone provided in the electronic apparatus from an external source, and generate an audio signal based on the input sound. A microphone may not be provided in the electronic apparatus, or an audio signal may be input from an external device by the setting.

The electronic apparatus may determine whether the output audio signal is matched with the received audio signal at step S830. The electronic apparatus may determine whether at least one of frequency, gain, level and phase of the output audio signal matches that of the received audio signal.

When the output audio signal is not matched with the received audio signal at step S830-N, the electronic apparatus may change the format of the test audio signal at step S840. For example, when the electronic apparatus outputs an audio signal in an SPDIF method, and the input audio signal is not matched with the output test audio signal, the electronic apparatus may determine that the connected speaker device using the SPDIF method does not exist, and output a test audio signal in the HDMI method.

When the output audio signal is matched with the input audio signal at step S830-Y, the electronic apparatus may identify that the electronic apparatus is connected to a speaker device in a specific format at step S840. For example, when the electronic apparatus outputs a test audio signal in the SPDIF method, and the input audio signal is matched with the output test audio signal, it is determined that the external speaker device is connected with the electronic apparatus in the SPDIF method.

The electronic apparatus may set a sound output setting with respect to a speaker device which is determined to be connected at step S860. The electronic apparatus may set sound output in a specific format to transmit an audio signal to the external speaker device connected thereto. For example, the electronic apparatus may set a sound output setting in the SPDIF method to output an audio signal to the external speaker device connected in the SPDIF method.

As described above, in the case where audio output in various formats is available in the electronic apparatus, whether the external speaker device is connected and the audio output format of the connected external speaker device may be identified automatically without additional mechanical configuration. Therefore, manufacturing costs may be reduced since additional mechanical configuration is not needed in manufacturing an electronic apparatus. In addition, not only whether the speaker device is connected in a specific format but also whether the speaker device properly operates may be identified, thereby enhancing user convenience.

The various exemplary embodiments described above may be implemented in a recording medium that may be read by a computer or a similar device using software, hardware, or a combination thereof. In accordance with hardware implementation, the exemplary embodiments described above may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and an electrical circuit for performing other functions. In some cases, exemplary embodiments described herein may be implemented by processor 130 itself. According to software implementation, exemplary embodiments such as the procedures and functions described herein may be implemented in separate software modules. Each of the software modules may perform one or more of the functions and operations described herein.

A command for controlling an electronic apparatus to perform an operation according to various exemplary embodiments described above may be stored in a non-transitory readable medium. Such non-transiently readable media may mounted on various devices.

The non-transitory computer readable medium refers to a medium that stores data semi-permanently rather than storing data for a very short time, such as a register, a cache, and a memory, and is readable by an apparatus. Specifically, the above-described various applications or programs may be stored in a non-transitory computer readable medium such as a compact disc (CD), a digital versatile disk (DVD), a hard disk, a Blu-ray disk, a universal serial bus (USB) memory stick, a memory card, and a read only memory (ROM), and may be provided.

Although exemplary embodiments have been shown and described, it will be appreciated by those skilled in the art that changes may be made to these exemplary embodiments without departing from the principles and spirit of the present disclosure. Accordingly, the scope of the present inventive concept is not to be construed as being limited to the described exemplary embodiments, but is defined by the appended claims as well as equivalents thereto.

What is claimed is:

1. An electronic apparatus comprising:

an output circuit;

an input circuit; and a processor configured to:

control the output circuit to output a plurality of different audio signals, the output circuit being connectable to a plurality of speaker devices, and based on a sound output from each of the plurality of speaker devices being received through the input circuit, obtain a plurality of audio signals based on a plurality of received sound, and identify whether each of the plurality of speaker devices is connected based on the plurality of different audio signals and the plurality of obtained audio signals.

2. The electronic apparatus as claimed in claim 1, wherein the processor is further configured to control the output circuit to cause each of the plurality of speaker devices to output the sound with a time difference that falls within a range.

3. The electronic apparatus as claimed in claim 1, wherein each of the plurality of different audio signals has a different range of at least one of frequency, gain, level or phase.

4. The electronic apparatus as claimed in claim 1, wherein the processor is further configured to control the output circuit to cause each of the plurality of speaker devices to sequentially output the sound according to the plurality of different audio signals.

5. The electronic apparatus as claimed in claim 1, wherein the input circuit comprises a communication circuit which receives the plurality of different audio signals from a remote control device that performs communication with the electronic apparatus.

6. The electronic apparatus as claimed in claim 1, wherein the input circuit comprises a microphone that receives the sound and obtains the plurality of audio signals based on the plurality of received sound, and wherein the processor is further configured to identify whether each of the plurality of speaker devices is connected.

7. The electronic apparatus as claimed in claim 1, further comprising:

a display configured to display a connection state of the electronic apparatus with each of the plurality of speaker devices, wherein the processor is further configured to control the display to display at least one of connection information with the plurality of speaker devices, and defect information of a connected speaker device, based on the result of identification.

8. The electronic apparatus as claimed in claim 1, wherein the processor is configured to control the output circuit to transmit, to the connected speaker device, audio output setting information on a speaker device connected to the electronic apparatus based on the result of identification.

9. The electronic apparatus as claimed in claim 1, wherein the output circuit comprises a plurality of output terminals corresponding to different formats, and wherein the processor is further configured to:

control the output circuit to provide the plurality of different audio signals to one output terminal of the output terminals, and identify whether the one output terminal is connected with the plurality of speaker devices according to the plurality of sound received through the input circuit.

10. The electronic apparatus as claimed in claim 9, wherein the format includes at least one of an SPDIF method, an HDMI method, a phone connector method and a USB port method.

11. A controlling method for an electronic apparatus, the method comprising:

controlling an output circuit of the electronic apparatus to output a plurality of different audio signals, the output circuit being connectable to a plurality of speaker devices;

based on a sound output from each of the plurality of speaker devices being received, obtaining a plurality of audio signals based on a plurality of received sound; and identifying whether each of the plurality of speaker devices is connected based on the plurality of different audio signals and the plurality of obtained audio signals.

12. The method as claimed in claim 11, wherein the controlling comprises controlling the output circuit to cause each of the plurality of speaker devices to output the sound with a time difference that falls within a range.

13. The method as claimed in claim 11, wherein each of the plurality of different audio signals has a different range of at least one of frequency, gain, level; or phase.

14. The method as claimed in claim 11, wherein the controlling comprises controlling the output circuit to cause each of the plurality of speaker devices to sequentially output the sound according to the plurality of different audio signals sequentially transmitting the audio signal by the plurality of speaker devices.

15. The method as claimed in claim 11, wherein the obtaining comprises receiving the plurality of different audio signals from a remote control device that performs communication with the electronic apparatus.

16. The method as claimed in claim 11, wherein the obtaining comprises:

receiving the sound; and obtaining the plurality of audio signals based on the plurality of received sound, wherein the identifying comprises identify whether each of the plurality of speaker devices is connected.

17. The method as claimed in claim 11, further comprising:

displaying at least one of connection information with the plurality of speaker devices, and defect information of a connected speaker device, based on the result of identification.

18. The method as claimed in claim 11, further comprising:

transmitting to the connected speaker device, audio output information on a speaker device connected to the electronic apparatus based on the result of identification.

19. The method as claimed in claim 11, wherein the controlling comprises controlling the output circuit providing the plurality of different audio signals to one output terminal of a plurality of output terminals corresponding to different formats, and wherein the identifying comprises identifying whether the one output terminal is connected with the plurality of speaker devices according to the plurality of sound.

20. A non-transitory computer readable recording medium storing computer program code which, when executed by a processor, performs operations comprising:

controlling an output circuit of the electronic apparatus to output a plurality of different audio signals, the output circuit being connectable to a plurality of speaker devices;

based on a sound output from each of the plurality of speaker devices being received, obtaining a plurality of audio signals based on a plurality of received sound; and identifying whether each of the plurality of speaker devices is connected based on the plurality of different audio signals and the plurality of obtained audio signals.

* * * * *